US008196766B2

(12) United States Patent
Schrayvogel

(10) Patent No.: US 8,196,766 B2
(45) Date of Patent: Jun. 12, 2012

(54) FOLDING CONTAINER

(75) Inventor: Ottmar A. H. Schrayvogel, Hamburg (DE)

(73) Assignee: Texas Oil Capital Holding Corporation, Sacramento, CA (US)

( * ) Notice: Subject to any disclaimer, the term of this patent is extended or adjusted under 35 U.S.C. 154(b) by 470 days.

(21) Appl. No.: 12/449,839

(22) PCT Filed: Feb. 28, 2007

(86) PCT No.: PCT/EP2007/001718
§ 371 (c)(1),
(2), (4) Date: Aug. 28, 2009

(87) PCT Pub. No.: WO2008/104193
PCT Pub. Date: Sep. 4, 2008

(65) Prior Publication Data

US 2010/0018967 A1 Jan. 28, 2010

(51) Int. Cl.

| | |
|---|---|
| ***B65D 6/00*** | (2006.01) |
| ***B65D 88/00*** | (2006.01) |
| ***B65D 8/14*** | (2006.01) |
| ***B65D 21/00*** | (2006.01) |
| ***B65D 85/62*** | (2006.01) |

(52) U.S. Cl. ..... 220/7; 220/1.5; 220/4.28; 206/508; 206/509

(58) Field of Classification Search ..... 220/6, 7, 220/1.5, 4.28, 811, 812, 813, 4.32, 4.31, 220/4.08, 4.29, 817, 819; 206/600, 517, 206/577, 509; 410/52
See application file for complete search history.

(56) References Cited

U.S. PATENT DOCUMENTS 3,612,330 A * 10/1971 Baer ..... 220/1.5
3,799,384 A * 3/1974 Hurkamp ..... 220/6
(Continued)

FOREIGN PATENT DOCUMENTS

EP 1 008 535 6/2000
(Continued)

OTHER PUBLICATIONS

PCT International Search Report, issued in PCT/EP2007/001718, mailed Jan. 9, 2008 (8 pages).

*Primary Examiner* — Bryon Gehman
*Assistant Examiner* — Shawn Braden
(74) *Attorney, Agent, or Firm* — Nash and Titus, LLC

(57) ABSTRACT

The invention relates to a folding container (100) having a first and second side wall (11, 13), a roof (10), a floor (20) as well as a face end (12) and a back end, wherein the first side wall (13) and the second side wall (11) are slideable along the roof (10) and along the floor (20) respectively in such a manner that the lateral parts (11, 13) are slideable inward of the container (100) until they lie parallel to the floor (20). In order to offset friction losses in the longitudinal rails of folding containers (100), the invention proposes that the roof (10) and the floor (20) are provided with spaced longitudinal rails (14, 15, 16, 17) running parallel to one another for a roll guide of the first side wall (13) slideable on the roof (10) and for a roll guide of the second side wall (11) slideable on the floor (20), wherein in the longitudinal rails (14, 15, 16, 17) tension springs (30) are integrated which with a folded-out container (100) are tensioned and with a folded-up container (100) are relaxed.

12 Claims, 6 Drawing Sheets

U.S. PATENT DOCUMENTS

| | | | | |
|---|---|---|---|---|
| 4,240,359 | A * | 12/1980 | Howe | 108/53.1 |
| 4,646,928 | A * | 3/1987 | Ono et al. | 220/6 |
| 5,509,559 | A * | 4/1996 | Okano et al. | 220/1.5 |
| 7,823,739 | B2 * | 11/2010 | Sadkin et al. | 220/6 |
| 7,870,970 | B2 * | 1/2011 | Fisk | 220/7 |
| 7,984,819 | B1 * | 7/2011 | Davis | 220/4.28 |

FOREIGN PATENT DOCUMENTS

| | | |
|---|---|---|
| FR | 2 213 430 | 8/1974 |
| GB | 2 353 275 | 2/2001 |
| WO | WO 2004/100712 | 11/2004 |

* cited by examiner

FOLDING CONTAINER

This application claims priority from PCT International application PCT/DE2007/001718 (filed Feb. 28, 2007), and the contents of this priority application is incorporated in its entirety by reference.

TECHNICAL AREA

The invention relates to a folding container having a first and second side wall, a roof, a floor as well as a face end and a back end, wherein the first side wall and the second side wall are slideable along the roof and along the floor respectively in such a manner that the lateral parts are slideable inwards of the container until they lie parallel with the floor.

PRIOR ART

Folding containers of the type mentioned at the outset are known and familiar to the person skilled in the art.

In general container traffic both by sea, on the road and on rail has gained increasing importance in recent years. The growth forecasts of sea traffic for example are based on the sustained growth of the world population (1.1 billion humans in the next 15 years), and the continued production shift into developing and into low-wage countries as well as the transformation of previous developing and threshold countries into industrial nations with the corresponding change in the respective foreign trade structures. Especially the countries of South East Asia and South America must be mentioned here. Through the ever more intensive economic obligation and international work division a continuously increasing exchange of goods takes place as part of changing production processes. The fact of the huge reduction in price of sea transports is additionally reflected here.

Without container transport, the quantities of goods exchanged between Far East, South America, the European Continent and Russia would be inconceivable. This increasingly requires the use of transports in containers. Here, the possibility of using folding containers reduces the transport and storage costs quite substantially, for example ¾ of the area required can be saved when stacking four folding containers on the place of a standard container. This in turn corresponds to total saving of 75% compared with the standard container. Since by using folding containers three more containers can be transported, this in turn corresponds to an additional capacity of 300%.

For this reason, additional efforts have been undertaken in the recent past to further develop folding containers.

EP 1 008 535 B1 states a folding container wherein the walls are hinged together so that the container can be folded up. Here, the floor of the container is hinged to a lateral longitudinal wall of the container. The wall, which forms the container ceiling, is further hinged to the second lateral longitudinal wall. A face end of the container in turn is attached by hinging to one of the two lateral longitudinal walls, to the floor or to the ceiling of the container.

In EP 1 008 535 B1 guide rails are additionally provided by which the hinged walls are guided. These guiding devices ensure that the container is reproducibly constructed and can be folded up. In EP 1 008 535 B1 it is mentioned that friction losses between the guide rails and the guide rollers are avoided. However, friction always occurs, also with the known folding containers. The occurrence of friction manifestations constitutes a problem with the known folding containers in that increased force has to be expended as a result and consequently more energies are also required in order to fold and unfold the container. This can for example become noticeable when folding the container by means of oil pressure system or electrohydraulically. Friction losses between guide roll and guide rails also slow down the folding operation. The folding up and unfolding of containers and the relocation of these containers however has to take place rapidly in order to satisfy the economical requirements in container shipping.

PRESENTATION OF THE INVENTION

Object, Solution, Advantages

Based on the shown disadvantages and taking into account the shown prior art of folding containers of the type mentioned at the outset the object of the present invention is therefore based on designing a folding container of the type mentioned at the outset in such a manner that friction losses resulting from the rolling movement in guide rails can be offset to a major part.

According to the invention, this object is solved through claim 1. Advantageous further developments are obtained from the subclaims.

According to the invention, the roof and the floor are initially provided with spaced longitudinal rails running parallel with one another for roll guidance of the first side wall slideable on the roof and for roll guidance of the second side wall slideable on the floor.

Through a number of spaced longitudinal rails running parallel to one another the forces are distributed to different roll guides so that friction losses between the rollers provided for the roll guides and the longitudinal rails are reduced. In addition, according to the invention, tension springs are integrated in the longitudinal rails which are tensioned with the folded out (unfolded) container and relaxed with the folded-up (folded) container. In that such tension springs are integrated in the longitudinal rails which promotes the rolling movement in the longitudinal rails and thus also the movement of the lateral parts, friction forces that occur between the rollers and longitudinal rails are offset.

The roll guides provided for the rollers can comprise joint pieces which run in the longitudinal rails during a rolling movement and are connected with an end of the tension springs. The other end of the tension spring can then be connected with an end of the longitudinal rail via a conventional fastening means. The connection of the tension spring with the joined piece, which holds the roller can likewise be effected via a conventional fastening means. The substantial point is that the tension springs are integrated in the longitudinal rails wherein the tension springs in each case are connected in such a fixed manner with a point of the floor or of the roof and in each case with a point of the lateral parts so that with a folded-out container the tension springs are tensioned and with a folded-up container the tension springs are relaxed. It is also conceivable that the tension springs are fastened to a roller fitting. The roller fitting can have a kind of clevis which accommodates a roller wherein a press pin is passed through the clevis and the roller. The clevis in turn is in connection with the lateral parts. It is an advantage for the rollers to run in ball bearings in order to facilitate the folding process.

The advantage of the invention consists in that with the tension springs an instrument that is easy to handle is available with which friction forces that occur during the rolling movement in the longitudinal rails can be effectively offset.

An advantageous embodiment of the invention provides that the face and back end is in the form of roll-up doors. The roll-up doors are embodied in lightweight construction for example as composite materials and are segmented in order to be able to follow the radial guide integrated in a roof. In vertical direction the roll-up doors are guided through the guides fastened to the lateral parts. To ensure these are waterproof, each lowermost segment of the roll-up doors is embodied with a rubber seal. Locking in the closed state is carried out with the help of commercially available locking elements.

Further advantageous embodiments of the invention are characterized in the subclaims.

BRIEF DESCRIPTION OF THE DRAWINGS

In the following the invention is explained in more detail by means of the drawings.

It shows in schematic representations.

BEST WAY TO CARRY OUT THE INVENTION

Figure 1:
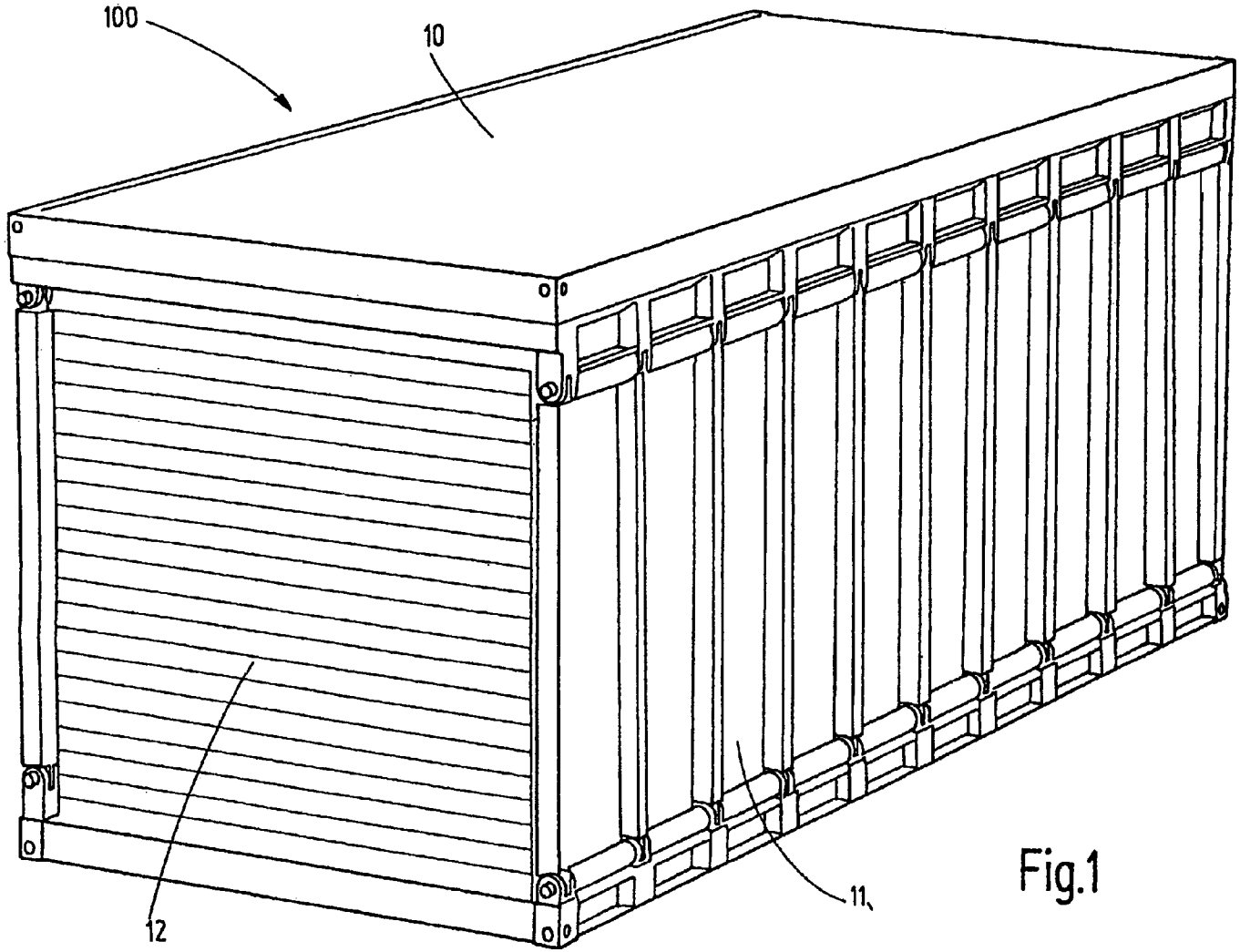
FIG. 1 a container according to the invention with a closed face end.

FIG. 1 shows a folding container according to the invention which is given the reference symbol 100.

The walling of the folding container 100, the face end 12 and the back end, the side walls 11, 13 and the roof 10 consists of a composite material which is characterized by low weight.

At the corner points, an eye plate or an eye each is worked into the roof 10 in order to lift the container 100 with a conventional lifting device in such a manner that it is released from an anchorage in the floor 20 and the roll guides are thus activated.

The folding container 100 comprises a first side wall 13 (see FIG. 2) and a second side wall 11, a roof 10, a floor 20 (see FIG. 2) and a face end 12 and a back end. Both the face end 12 as well as the back end can be present in the form of roll-up doors.

Figure 2:
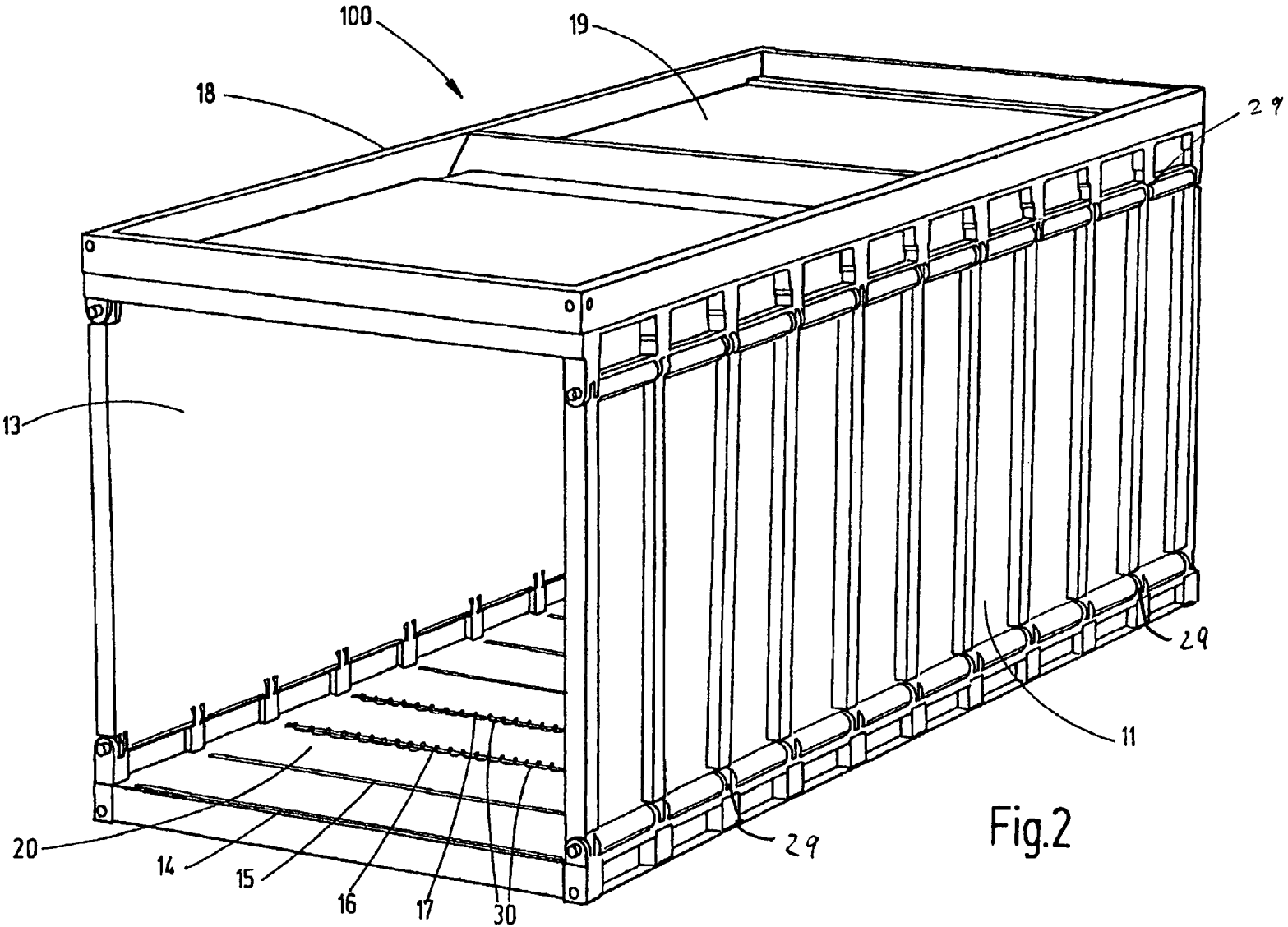
FIG. 2 the container with opened face end, wherein tensioned tension springs are integrated in the longitudinal rails.

FIG. 2 shows the roll container according to the invention with an opened face end 12. The floor 20 consists of a strong steel frame, a steel floor plate as well as cross members which are provided with the longitudinal rails 14, 15, 16, 17 for a roller guide of the second lateral part 11 displaceably mounted on the floor 20. The quantity of the cross members corresponds to the quantity of cross members in the roof 10. In the longitudinal rails 14, 15, 16, 17 tension springs 30 are installed which with the folded-out container 100 shown here are tensioned and in a folded-up state of the container 100 are relaxed. These tension springs 30 support the rolling of the joints in the longitudinal rails and thus the swivelling of the lateral parts 11, 13 upon lowering of the roof 10. Cross members of the floor 20 increase the stability of the floor 20. At the top of the floor 20 eye plates 29 are welded on on one side which ensure a positive connection with the second lateral part 11. In addition, the floor 20 can be provided with corner fittings for conventional transport and loading devices. To achieve a necessary waterproof state of the folded-open container 100, rubberised sealing lips can be provided on the longitudinal sides of the roof 10 which guarantees waterproof sealing between the roof 10 and the lateral parts 11, 13.

Figure 3:
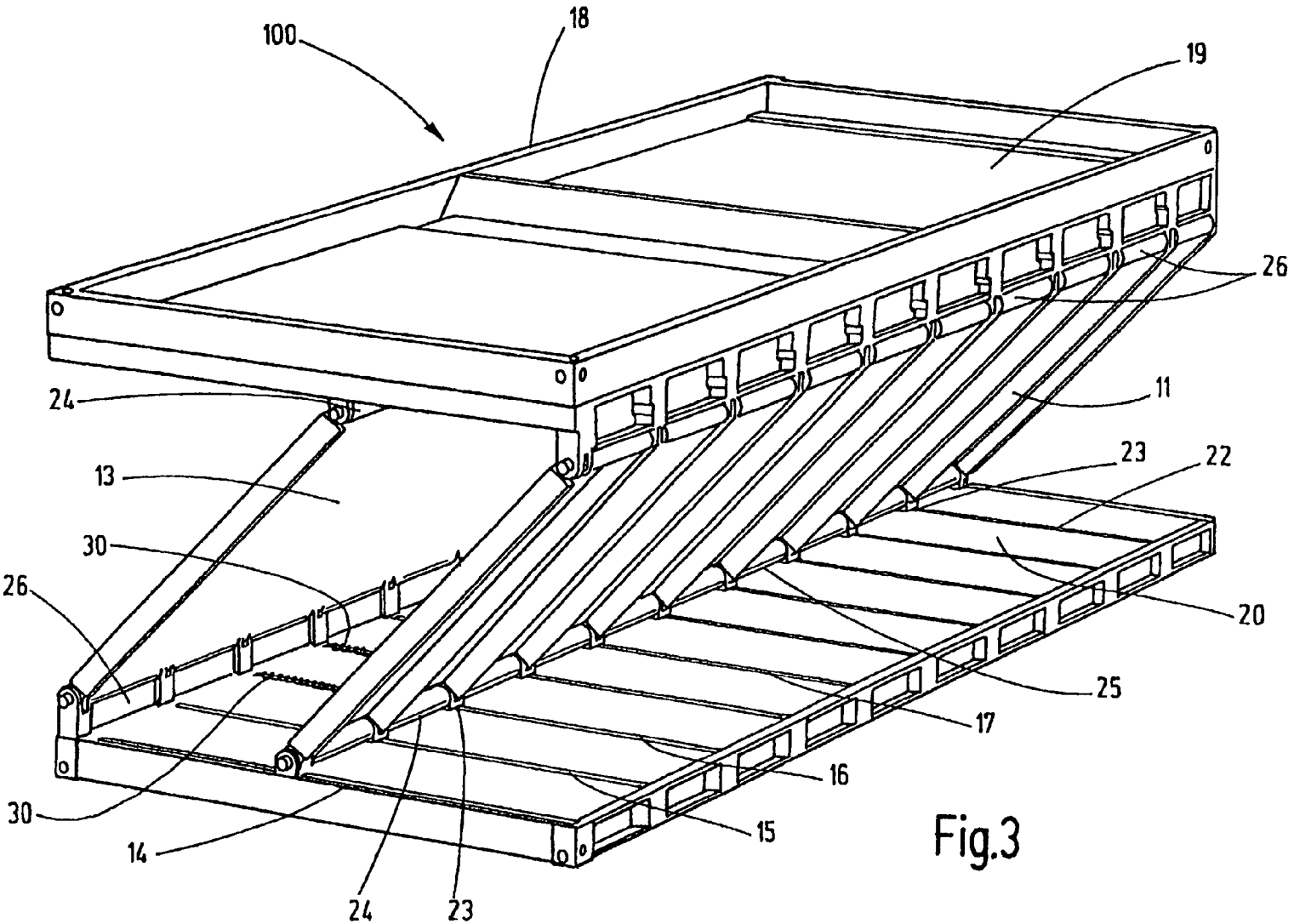
FIG. 3 the container during the folding process, wherein the tension springs in the longitudinal rails relax.
Figure 4:
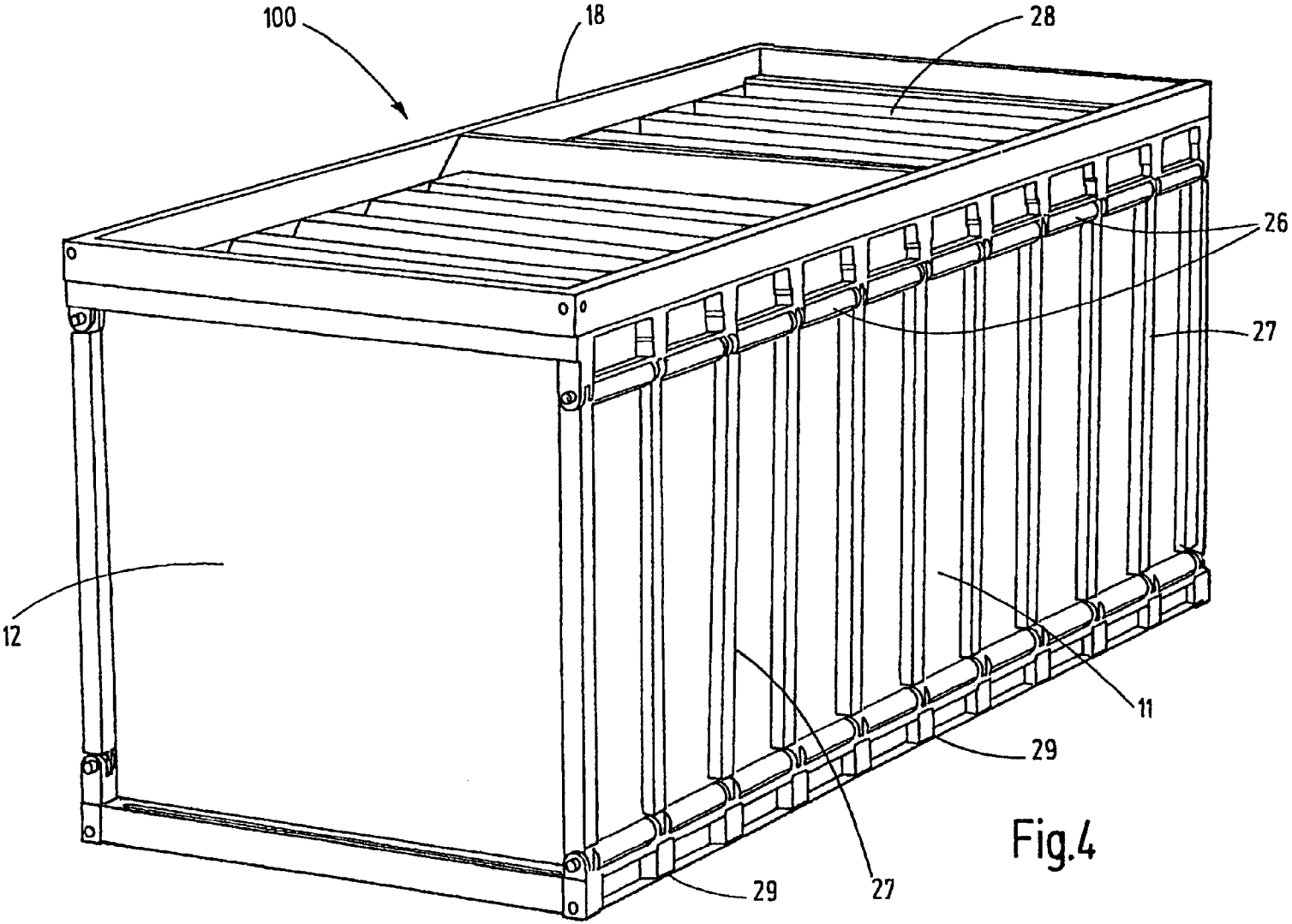
FIG. 4 the container according to the invention with a closed face end and with a support of composite material arranged on the roof.

As is evident from FIG. 3, the tension springs 30 relax during the folding process of the container 100. As is additionally evident from FIGS. 3 and 4, the lateral parts 11, 13 comprise square hollow profiles 27 which on top and bottom are provided with tube profiles 24 in order to create a stiff frame. A cover plate 21 is fixed onto the inside of the square profiles 27 and forms a smooth internal surface of the lateral parts 11, 13. For the sake of weight reduction, the cover plate 21 is manufactured of high-strength composite material. The lateral parts 11, 13 are each fastened once to the roof 10 or the floor 20 in a fixed manner with the help of a slid-in shaft 26. On each of the slideable sides of the lateral parts 11, 13, roller-guided joint pieces 23 are installed with the help of a slid-in shaft. The tension springs 30 are then each fastened to the joint piece 23 and to the respective end of the longitudinal rail via appropriate fastening means. For example hooks, which are guided in openings of the tension springs 30 provided for this purpose can serve as fastening means.

As is additionally evident from the FIGS. 1 to 4 the roof 10 consists of a strong hollow profile steel frame 18 and a wave-shaped support 28 of composite material arranged on the roof. The frame 18 is equipped with suitable corner fittings for conventional transport and loading devices as well as forklift pockets on the longitudinal sides. At the bottom of the roof 10 eye plates 29 are welded on on one side which ensure a positive connection with one of the lateral parts 11, 13. In addition, the roof 10 is equipped with cross members which are provided with the longitudinal rails 14, 15, 16, 17 for the roll guide of the second lateral part 11 displaceably mounted on the roof 10. The cross members simultaneously increase the stability of the roof 10. The roof 10 also has longitudinal rails 14, 15, 16, 17 which are not shown in this embodiment in which tension springs 30 are installed. With the folded-out container 100 the tension springs 30 are likewise tensioned in this case and relaxed with the container folded up. These tension springs support the rolling of the joint pieces 23 in the longitudinal rails 14, 15, 16, 17 also here and thus the moving-in of the lateral parts 11, 13 upon lowering of the roof 10 during the folding process. Here, too, the outer skin 19 of the roof 10 is formed of high-strength composite material for the sake of considerable weight reduction. The lateral parts 11, 13 are provided with square hollow profiles 27 which make possible transmission of the vertically acting forces from the roof 10 to the floor 20.

Figure 5:
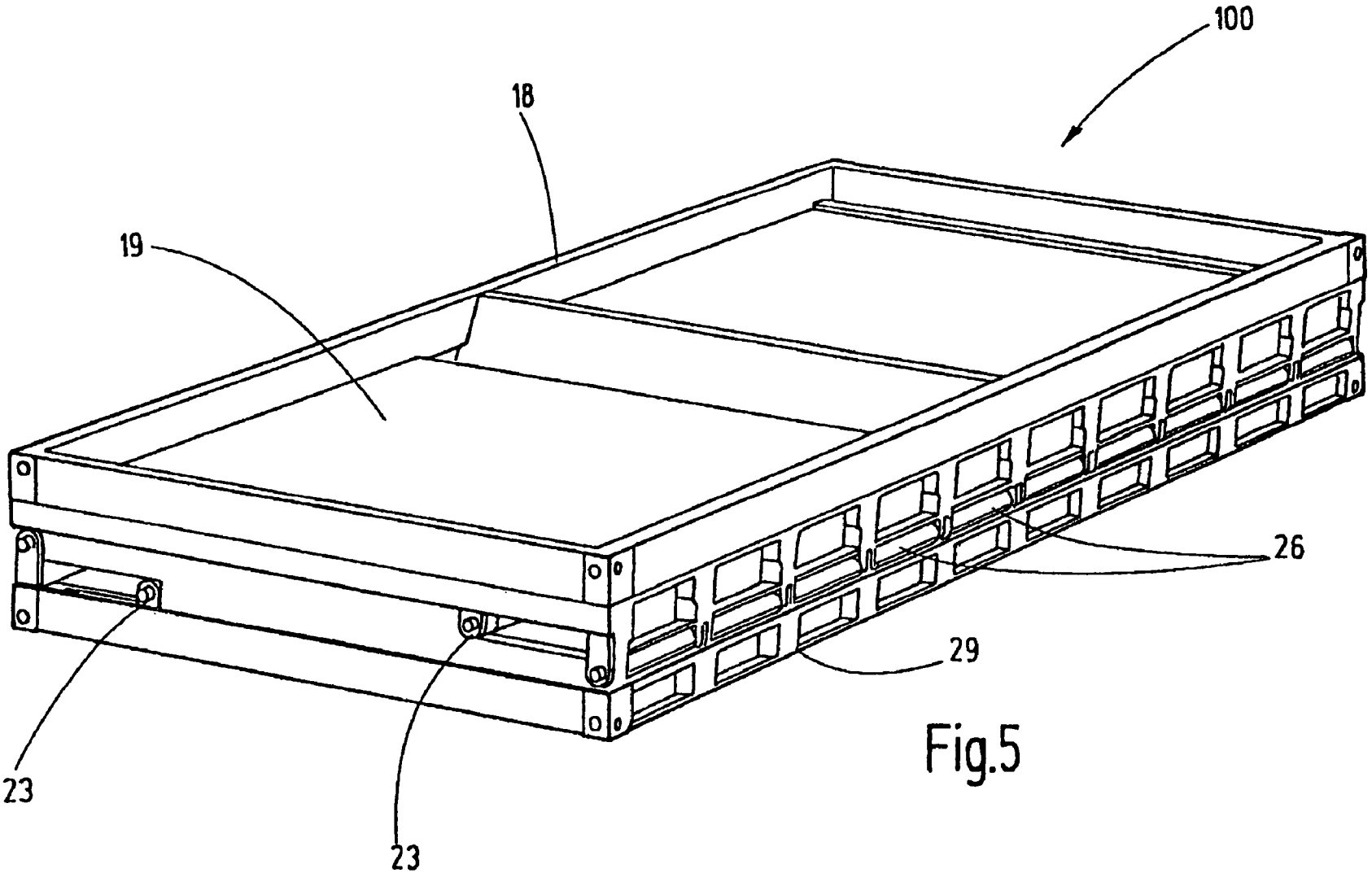
FIG. 5 the container according to the invention in a folded-up state.
Figure 6:
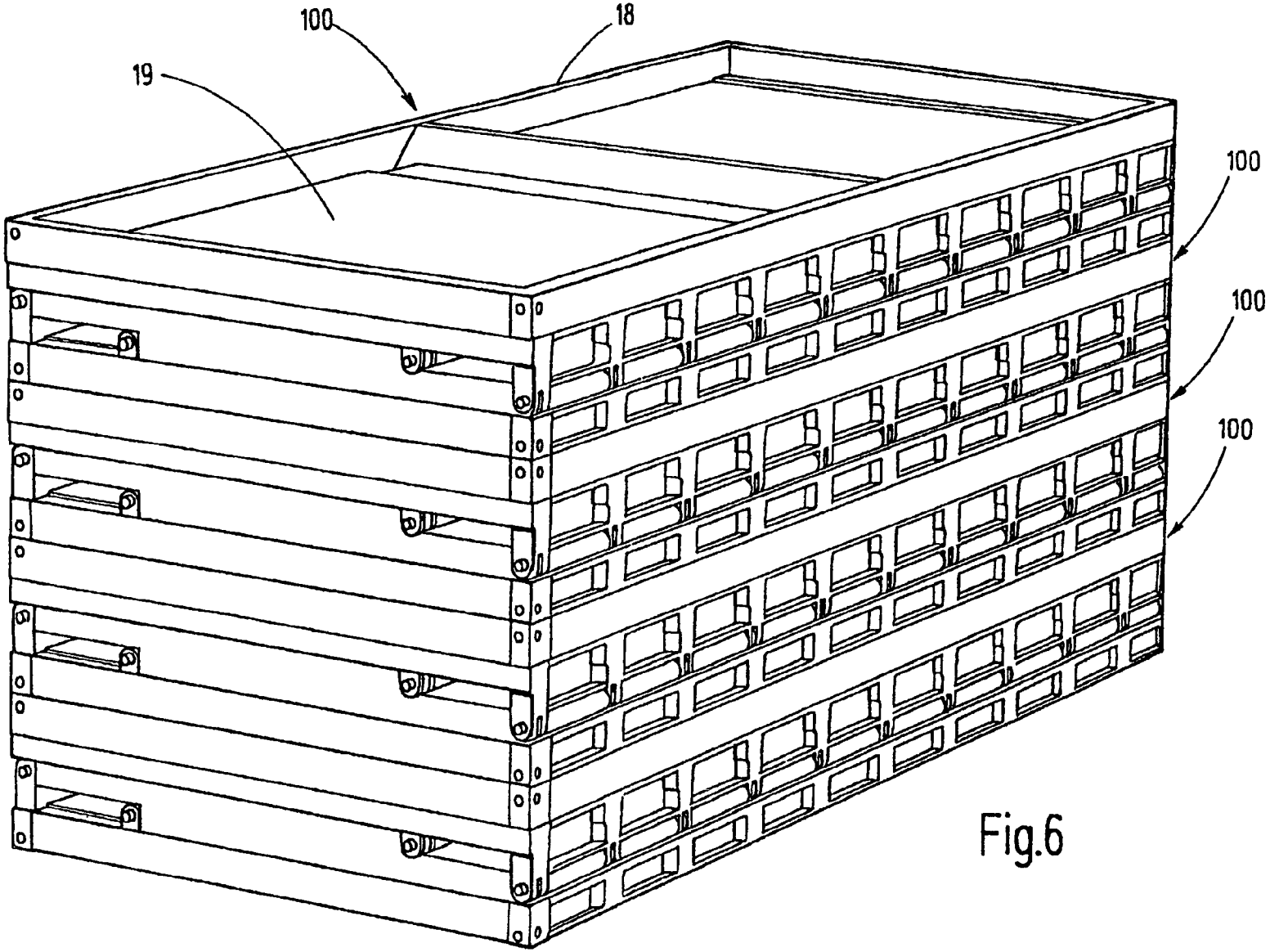
FIG. 6 a plurality of containers according to the invention which are folded up and lie on top of one another.

FIG. 5 shows the container according to the invention in the folded-up state. FIG. 6 once more gives an impression of the major space saving that can be achieved when a plurality of folding containers 100 according to the invention are arranged in the folded-up form on top of one another.

LIST OF REFERENCE SYMBOLS

100 Folding container
10 Roof
11 Second side wall
12 Face end
13 First side wall
14 Longitudinal rail
15 Longitudinal rail
16 Longitudinal rail
17 Longitudinal rail
18 Hollow profile steel frame
19 Outer skin
20 Floor
21 Cover plate

23 Joint piece
24 Tube profile
26 Shaft
27 Square profile
28 Wave-shaped support
29 Eye plate
30 Tension spring

The invention claimed is:

1. A folding container having a first side wall and a second side wall, a roof, a floor, a face end and a back end, wherein the first and second side walls have slideable lateral parts, and wherein the first side wall and the second side wall are slideable along the roof and along the floor respectively in such a manner that the slideable lateral parts are slideable inward of the container until they lie parallel to the floor, characterized in that the roof and the floor are provided with spaced longitudinal rails running parallel to one another for a roll guide of the first side wall slideable on the roof and for a roll guide of the second side wall slideable on the floor, wherein tension springs are integrated in the longitudinal rails which with a folded-out container are tensioned and with a folded-up container are relaxed.

2. The folding container according to claim 1, characterized in that either or both of the face and the back end is present in the shape of roll-up doors.

3. The folding container according to claim 2, characterized in that the roll-up doors are guidable through guides fastened to the side walls.

4. The folding container according to claim 1, characterized in that the roof has a hollow profile steel frame.

5. The folding container according to claim 1, characterized in that the roof is equipped with cross members.

6. The folding container according to claim 1, characterized in that the roof is provided with an outer skin which is formed of a high-strength composite material.

7. The folding container according to claim 1, characterized in that the floor is provided with cross members.

8. The folding container according to claim 7, characterized in that the roof is provided with cross members, and the quantity of the cross members of the floor corresponds to the quantity of cross members of the roof.

9. The folding container according to claim 1, characterized in that the side walls are provided with square hollow profiles.

10. The folding containers according to claim 9, characterized in that on the square profiles a cover plate is fixed which forms a smooth inner surface of the side walls.

11. The folding container according to claim 1, characterized in that the folding of the container is effected through an oil pressure system or semi-hydraulically or through electro-hydraulics and/or through a lifting device.

12. The folding container according to claim 1, characterized in that the face end, the back end, the side walls and the roof are made of a composite material.

* * * * *